US009761978B2

(12) United States Patent
Kim et al.

(10) Patent No.: US 9,761,978 B2
(45) Date of Patent: Sep. 12, 2017

(54) MULTI-GROUND CONNECTOR FOR VEHICLE

(71) Applicants: HYUNDAI MOTOR COMPANY, Seoul (KR); KIA MOTORS CORPORATION, Seoul (KR); KUM CO., LTD., Ulsan (KR)

(72) Inventors: Mun Jong Kim, Suwon-si (KR); Min Kyu Kim, Suwon-si (KR); Sung Won Jeon, Ulsan (KR); Dong Hoon Lee, Ulsan (KR)

(73) Assignees: HYUNDAI MOTOR COMPANY, Seoul (KR); KIA MOTORS CORPORATION, Seoul (KR); KUM CO., LTD., Ulsan (KR)

( * ) Notice: Subject to any disclaimer, the term of this patent is extended or adjusted under 35 U.S.C. 154(b) by 0 days.

(21) Appl. No.: 15/218,168

(22) Filed: Jul. 25, 2016

(65) Prior Publication Data

US 2017/0098904 A1 Apr. 6, 2017

(30) Foreign Application Priority Data

Oct. 6, 2015 (KR) ..... 10-2015-0140599

(51) Int. Cl.

| | |
|---|---|
| ***H01R 13/14*** | (2006.01) |
| ***H01R 13/502*** | (2006.01) |
| ***H01R 13/516*** | (2006.01) |
| ***H01R 13/52*** | (2006.01) |
| ***H01R 13/73*** | (2006.01) |
| ***H01R 4/64*** | (2006.01) |

(Continued)

(52) U.S. Cl.

CPC ..... *H01R 13/14* (2013.01); *H01R 4/64* (2013.01); *H01R 13/502* (2013.01); *H01R 13/516* (2013.01); *H01R 13/521* (2013.01); *H01R 13/73* (2013.01); *H01R 31/08* (2013.01); *H01R 13/4361* (2013.01)

(58) Field of Classification Search

CPC ..... H01R 13/14; H01R 4/64; H01R 13/502; H01R 13/516; H01R 13/521

USPC ..... 439/386

See application file for complete search history.

(56) References Cited

U.S. PATENT DOCUMENTS 5,403,204 A * 4/1995 Chishima ..... H01R 31/08 439/189

5,749,753 A * 5/1998 Chishima ..... H01R 13/113 439/752.5

(Continued)

FOREIGN PATENT DOCUMENTS

| | | |
|---|---|---|
| JP | 2675477 | 7/1997 |
| JP | 3094870 | 8/2000 |

(Continued)

OTHER PUBLICATIONS

Korean Office Action dated May 26, 2017 form the corresponding Korean Application No. 10-2015-0140599, 2 pp.

*Primary Examiner* — Alexander Gilman

(74) *Attorney, Agent, or Firm* — Brinks Gilson & Lione

(57) ABSTRACT

A multi-earth connector for a vehicle includes: a ground terminal to include a ground portion fixed to a vehicle body and pin terminals arranged in a plurality of rows; a socket terminal to include sockets inserted into the pin terminals and barrels to which an earth wiring is fixed; and a side holder coupled with the pin terminals and the sockets to inhibit a movement of the socket terminal.

14 Claims, 8 Drawing Sheets

(51) Int. Cl.
*H01R 31/08* (2006.01)
*H01R 13/436* (2006.01)

(56) References Cited

U.S. PATENT DOCUMENTS 5,855,493 A * 1/1999 Shelly ..... H01R 13/516 439/465
6,217,394 B1 * 4/2001 Sugie ..... H01R 13/5208 439/587
6,276,964 B1 * 8/2001 Shinozaki ..... H01R 13/424 439/595
6,361,379 B1 * 3/2002 Ito ..... H01R 13/4223 439/692
6,840,820 B2 * 1/2005 Oda ..... H01R 13/518 439/721
6,896,560 B2 * 5/2005 Nakamura ..... H01R 13/4362 439/345
6,948,986 B2 * 9/2005 Kojima ..... H01R 13/432 439/595
7,204,726 B2 * 4/2007 Yamashita ..... H01R 13/4362 439/752
7,241,168 B2 * 7/2007 Sakurai ..... H01R 31/085 439/511
8,100,730 B2 * 1/2012 Hara ..... H01R 4/64 439/721
8,137,116 B2 * 3/2012 Omori ..... H01R 4/64 439/883
8,398,433 B1 * 3/2013 Yang ..... H01R 13/6587 439/108
8,523,583 B2 * 9/2013 Ito ..... H01R 12/721 439/108
8,992,251 B2 * 3/2015 Smutny ..... H01R 31/08 439/511
9,083,094 B2 * 7/2015 Teramoto ..... H01R 4/64
9,211,852 B2 * 12/2015 Omori ..... H01R 4/64
9,252,526 B2 * 2/2016 Cho ..... H01R 4/023
9,300,093 B2 * 3/2016 Omori ..... H01R 4/64
9,318,827 B2 * 4/2016 Osada ..... H01R 13/4223
9,496,108 B2 * 11/2016 Kawamura ..... H01H 50/048
2003/0060075 A1 * 3/2003 Nakamura ..... H01R 13/4223 439/345
2006/0128185 A1 * 6/2006 Nakazawa ..... H01R 31/08 439/92
2010/0071953 A1 * 3/2010 Ichio ..... H01R 13/40 174/72 A
2011/0111639 A1 * 5/2011 Hara ..... H01R 4/64 439/660
2013/0330956 A1 * 12/2013 Shimizu ..... H01R 13/4223 439/345
2014/0134869 A1 * 5/2014 Hamai ..... H01R 13/111 439/345
2014/0235090 A1 * 8/2014 Omori ..... H01R 4/64 439/350
2015/0194757 A1 * 7/2015 Osada ..... H01R 13/4223 439/357
2015/0214658 A1 * 7/2015 Nishiyama ..... H01R 24/76 439/357

FOREIGN PATENT DOCUMENTS

JP 2002-075507 3/2002
JP 2002-203632 7/2002
JP 2003-346965 12/2003
JP 2012-146523 8/2012
KR 10-2014-0036035 A 3/2014
KR 10-2014-0107070 9/2014
KR 10-1470276 B1 12/2014

* cited by examiner

MULTI-GROUND CONNECTOR FOR VEHICLE

CROSS-REFERENCE TO RELATED APPLICATION

This application claims the benefit of Korean Patent Application No. 10-2015-0140599, filed on Oct. 6, 2015, which is incorporated herein by reference in its entirety.

FIELD

The present disclosure relates to a multi-ground connector for a vehicle.

BACKGROUND

The statements in this section merely provide background information related to the present disclosure and may not constitute prior art.

In general, various types of electric components (or devices) are installed in vehicles, and such electric components have mutually organic connection relations on the basis of an electronic control unit (ECU). Also, in order to standardize assembling and replacement, most electric components have connections with connectors inserted into output terminals and input terminals, and thus, most electric components have a plurality of installation connectors.

That is, various electric components such as a battery, an ignition device, a starting device, a charging device, a lighting device, a horn, a power window regulator, a wind shield wiper, various measuring instruments, and a cooling device and a heating device as air-conditioning devices are installed in vehicles and, in order for these electric components be electrically connected to a power source, electric wirings and terminals are required.

Various electronic equipment is configured to be operated upon receiving power from a battery and a power generator, and here, a positive (+) terminal is directly connected to an electric wire, while a grounded negative (−) terminal is connected to a vehicle body adjacent to an installation portion of an electronic component so as to be grounded. The reason why the negative (−) terminal of an electronic component is connected to an adjacent vehicle body is because the entirety of the vehicle body serves as a grounding point.

In vehicles, in order to connect various electric components to a battery, a vehicle body is used as a ground. For example, a positive electrode terminal of a battery is directly connected to electric components, but a negative electrode terminal is connected to electronic components in a manner of being grounded to a vehicle body. Here, even though the negative electrode terminal of the battery is grounded to a vehicle body, it has the same effect as that obtained when directly connected to an electronic component.

Recently manufactured vehicles include various types of electric components, and in order to simultaneously ground these electric components, a multi-ground terminal is used. A multi-ground terminal has a structure in which a plurality of ground terminals are stacked to be tightly attached and fixed using ground bolts.

SUMMARY

An aspect of the present disclosure is to reduce a space required to be large as barrels are radially disposed when ground terminals are stacked. Also, another aspect of the present disclosure is to automate a manual manufacturing process to increase productivity. Also, another aspect of the present disclosure is to provide a multi-ground connector for a vehicle in which an electric wire connected to a barrel is not exposed.

According to one form of the present disclosure, a multi-ground connector for a vehicle includes: a ground terminal including a ground portion fixed to a vehicle body and pin terminals arranged in a plurality of rows; a socket terminal including sockets inserted into the pin terminals and barrels to which a ground wiring is fixed; and a side holder coupled in a direction perpendicular to a direction of the pin terminals and the sockets to inhibit a movement of the socket terminal.

The sockets may be formed in a plurality of rows so as to be inserted into the pin terminals, the sockets in the plurality of rows may include: first sockets in one row and second sockets in one row below the first sockets, wherein the second sockets are disposed between valleys of the first sockets.

The pin terminals may be arranged such that first terminals thereof are inserted into the first sockets and second terminals are staggered with respect to the first terminals so that the second terminals thereof are inserted into the second sockets.

The first sockets and the second sockets may each have an insertion recess into which the side holder is inserted.

An end portion of the first sockets and second sockets may form a protrusion that protrudes toward the interior of the first sockets and second sockets.

The side holder may have a plurality of guide portions to be inserted into the first sockets and the second sockets.

The plurality of guide portions may include a first guide inserted into an upper side of the first sockets, a second guide inserted into a lower side of the second sockets, and a third guide disposed between the first guide and the second guide and configured to penetrate through a space between the first sockets and the second sockets.

A stoppage hole may be formed at a front end of each of the pin terminals and coupled to the protrusion to inhibit a movement of the socket terminal.

The sockets may each have a U shape surrounding the pin terminals.

The multi-ground connector may further include a housing in which the ground terminal and the socket terminal are disposed therein, wherein the ground terminal may be disposed such that the ground portion and the ground wiring protrude outwardly from the housing.

The housing may have a guide recess configured to allow the side holder to be inserted therein, and the side holder may be inserted into the guide recess and the insertion recess.

A coupling hole to be caught by the housing may be formed in each of the first guide and the second guide.

The housing may include: a first housing configured to have an accommodation space in which the ground terminal and the sockets are disposed; and a second housing coupled to the top of the first housing, wherein a waterproof pad configured to protect the ground terminal and the sockets may be disposed in the accommodation space.

A plurality of waterproof pads may be provided, and the pin terminals may be disposed between the plurality of waterproof pads.

A mounting recess on which the waterproof pad is disposed may be formed in the accommodation space, and the pin terminals may be disposed on the waterproof pad disposed on the mounting recess.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
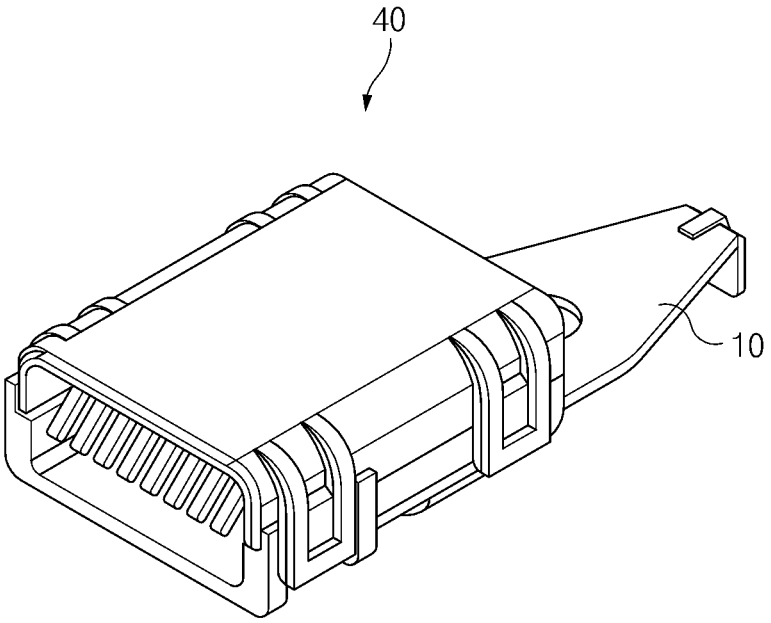
FIG. 1 is a perspective view illustrating a multi-ground connector for a vehicle.
Figure 2:
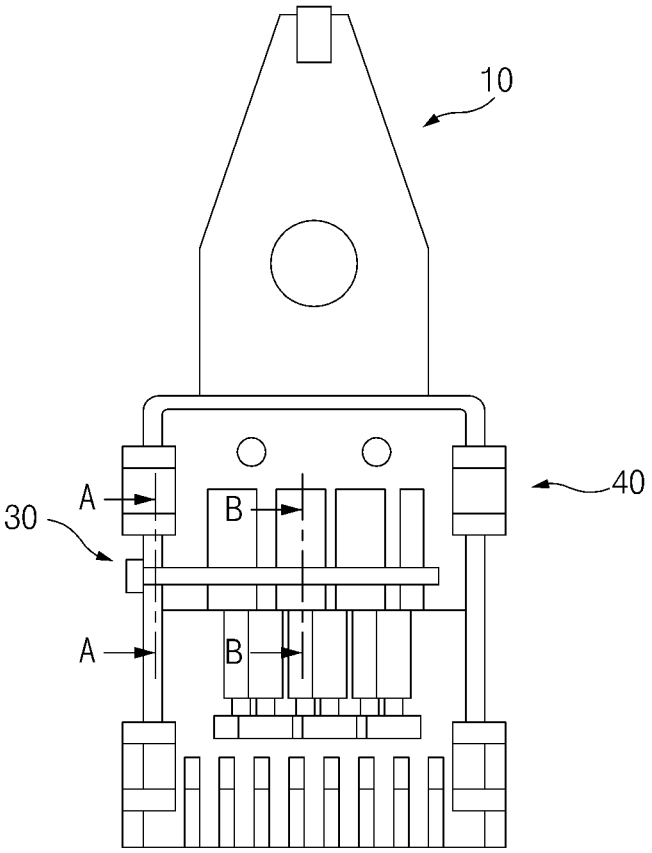
FIG. 2 is a plan view of FIG. 1.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIGS. 1 through 5, the multi-ground connector for a vehicle according to one form of the present disclosure includes: a ground portion fixed to a vehicle body; a ground terminal 10 in which pin terminals are arranged in a plurality of rows; a socket terminal 20 including sockets 22 inserted into the pin terminals 16 and barrels 26 to which ground wirings are fixed; and a side holder 30 coupled in a direction perpendicular to a direction of the pin terminal 16 and the socket 20 to inhibit a movement of the socket terminal 20.

The ground terminal 10 includes a ground portion 12 fixed to a vehicle body and the pin terminals 16 arranged in a plurality of rows. In the ground terminal 10, the pin terminals 16 arranged in a plurality of rows are formed in an extending portion 14 extending from the ground portion 12 fixed to a vehicle body. The ground portion 12 may have a through hole to be fixed to the vehicle body.

The pin terminals 16 are provided to be arranged in a plurality rows in the extending portion 14. The pin terminals 16 are formed in two upper and lower rows. Stoppage holes 16*a* are formed at front ends of the pin terminals 16 and coupled to protrusions 22*a* provided to inhibit a movement of the socket terminal 20. The pin terminals 16 include first terminals in an upper one row and second terminals in a lower one row, and the first terminals and the second terminals are provided to be staggered.

In the socket terminal 20, the sockets 22 inserted into the pin terminals 16 and the barrels 26 to which a ground wiring is fixed are formed. The sockets 22 are formed in a plurality of rows. The sockets 22 in the plurality of rows include first sockets 22*a* in an upper one row and second sockets 22*b* in a lower one row. In the sockets 22, the second sockets may be disposed between valleys of the first sockets 22*a*. In the sockets 22, the first sockets 22*a* and the second sockets 22*b* are staggered with each other. The first terminals are inserted into the first sockets 22*a*, and the second terminals are inserted into the second sockets 22*b*.

The first sockets 22*a* and the second sockets 22*b* may have insertion recesses into which the side holder 30 is inserted. In one form, an insertion recess 22*a*' is formed in the first socket 22*a*. A protrusion 24 protruding inwardly may be formed in an end portion of each of the first sockets 22*a*.

A protrusion 24 protruding inwardly may be formed in an end portion of each of the second sockets 22*b*, like the first sockets 22*a*. The socket 22 may have a U shape surrounding the pin terminal 16. The barrel 26 may include a first barrel 26*a* extending from the first socket 22*a* and a second barrel 26*b* extending from the second socket 22*b*.

The side holder 30 is coupled in a direction perpendicular to the direction of the pin terminal 16 and the socket 22 in order to inhibit a movement of the socket terminal 20. The side holder 30 may have a plurality of guide portions 32, 34, and 36 to be inserted into to first socket 22*a* and the second socket 22*b*. The side holder 30 may have a handle portion 30*a* to be pushed into the housing 40. In the side holder 30, the guide portions 32, 34, and 36 extend from the handle portion 30*a*.

The guide portions 32, 34, and 36 may include a first guide 32 inserted in an upper side of the first socket 22*a*, a second guide 34 inserted into a lower side of the second socket 22*b*, and a third guide 36 formed between the first guide 32 and the second guide 34 and penetrating through a space between the first socket 22*a* and the second socket 22*b*.

Coupling holes 32*a* and 34*a* caught by the housing 40 may be formed in the first guide 32 and the second guide 34, respectively. The coupling holes 32*a* and 34*a* may include a first coupling hole 32*a* formed in the first guide 32 and a second coupling hole 34*a* formed in the second guide 34. The first coupling hole 32*a* and the second coupling hole 34*a* are caught in insertion recesses of the housing 40 to inhibit the side holder 30 from being excessively entering guide recesses 43 and 47 or released therefrom.

The housing 400 is provided to cover the ground terminal 10 and the socket terminal 20. The housing 40 forms an outer appearance such that the ground terminal 10 and the socket terminal 2 are disposed therein. In the housing 40, the ground portion 12 of the ground terminal 10 protrudes outwardly from the housing 40 and fixed to a vehicle or connected to a ground wiring.

The housing 40 has guide recesses 43 and 47 into which the side holder 30 is inserted. The housing has a first housing 42 having an accommodation space in which the ground terminal 10 and the socket 20 are disposed.

Figure 6:
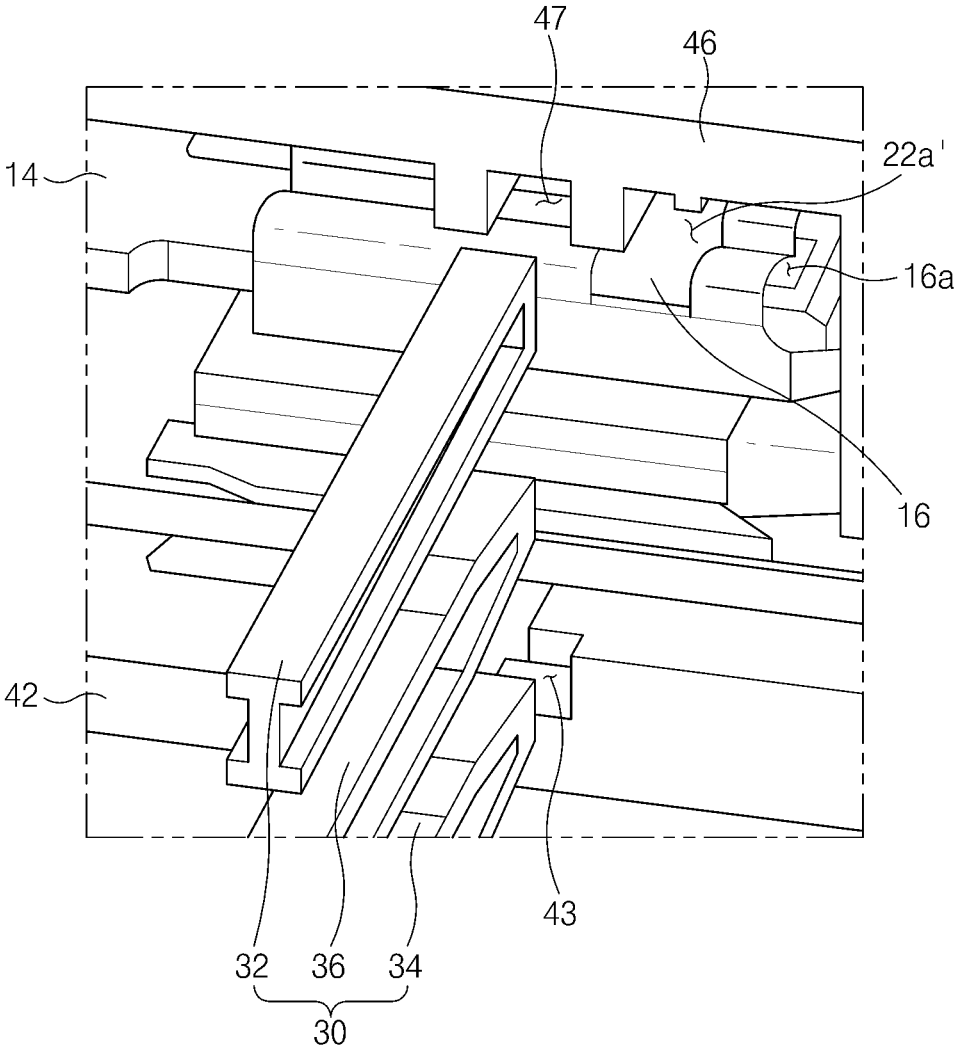
FIG. 6 is a cross-sectional view taken along line A-A of FIG. 2.
Figure 7:
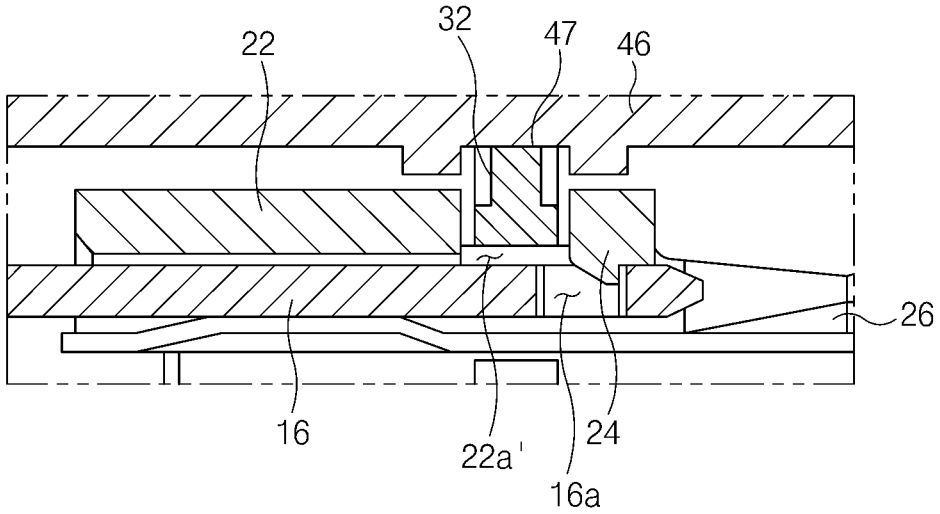
FIG. 7 is a cross-sectional view taken along line B-B of FIG. 2.
Figure 8:
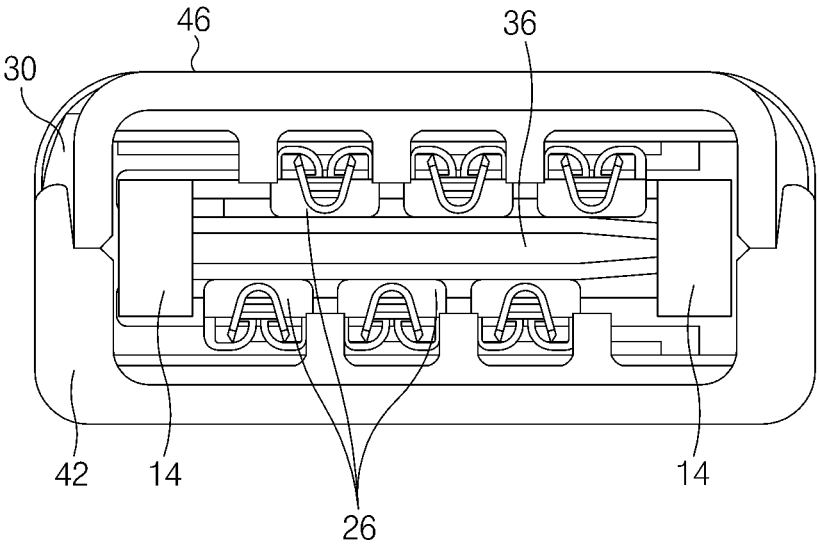
FIG. 8 is a side view illustrating a socket terminal in which a pin terminal of FIG. 7 is inserted.

In the housing 40, a second housing 46 is coupled to the top of the first housing 42 to cover the accommodation space. Here, in the housing 40, the accommodation space formed in the first housing 42 and the accommodation space formed in the second housing 46 are the same, and thus, the first housing 42 will be described as an example. Referring to FIG. 6, the guide recess formed in the first housing 42 of the housing 40 will be described as an example. The guide recess 43 and the insertion recess 22*a*' may be disposed to be perpendicular with respect to each other such that the side holder 30 is inserted therein.

The ground terminal 10 and the socket 20 are coupled and disposed in the accommodation space of the first housing 42.

A waterproof pad 52 may be disposed in the accommodation space of the first housing 42 in order to protect the ground terminal 10 and the socket 20. A mounting recess 42*a* on which the waterproof pad 52 is disposed is formed in the accommodation space.

The pin terminals 16 may be disposed above the waterproof pad 52 disposed on the mounting recess 42*a*. The first housing 42 may have hook portions 42*b* to be coupled to the second housing 46. Hook stoppage portions 46*b* may be formed in the second housing 46 such that the hook stoppage portions 46*b* are caught by the hook portions 42*b*. The hook portions 42*b* and the hook stoppage portions 46*b* are formed on outer circumferential surfaces of the first housing 42 and the second housing 46, respectively.

A plurality of waterproof pads 52 and 54 may be disposed above and below the pin terminals 16 so as to be fixed to the housing 40. The waterproof pads 52 and 64 may include a first pad 52 disposed below the pin terminals 16 and a second pad 54 disposed above the pin terminals 16.

An operation of the multi-ground connector for a vehicle will be described.

Referring to FIGS. 1 through 5, the ground terminal 10 and the socket terminal 20 are coupled. The sockets 22 are inserted into the pin terminals 16. Here, the protrusions 22*a* of the sockets 22 are insertedly coupled to the stoppage holes 16*a* of the pin terminals 16. Thus, the socket terminal 20 is inhibited from being released from the ground terminal 10, reducing arc generation.

Figure 4:
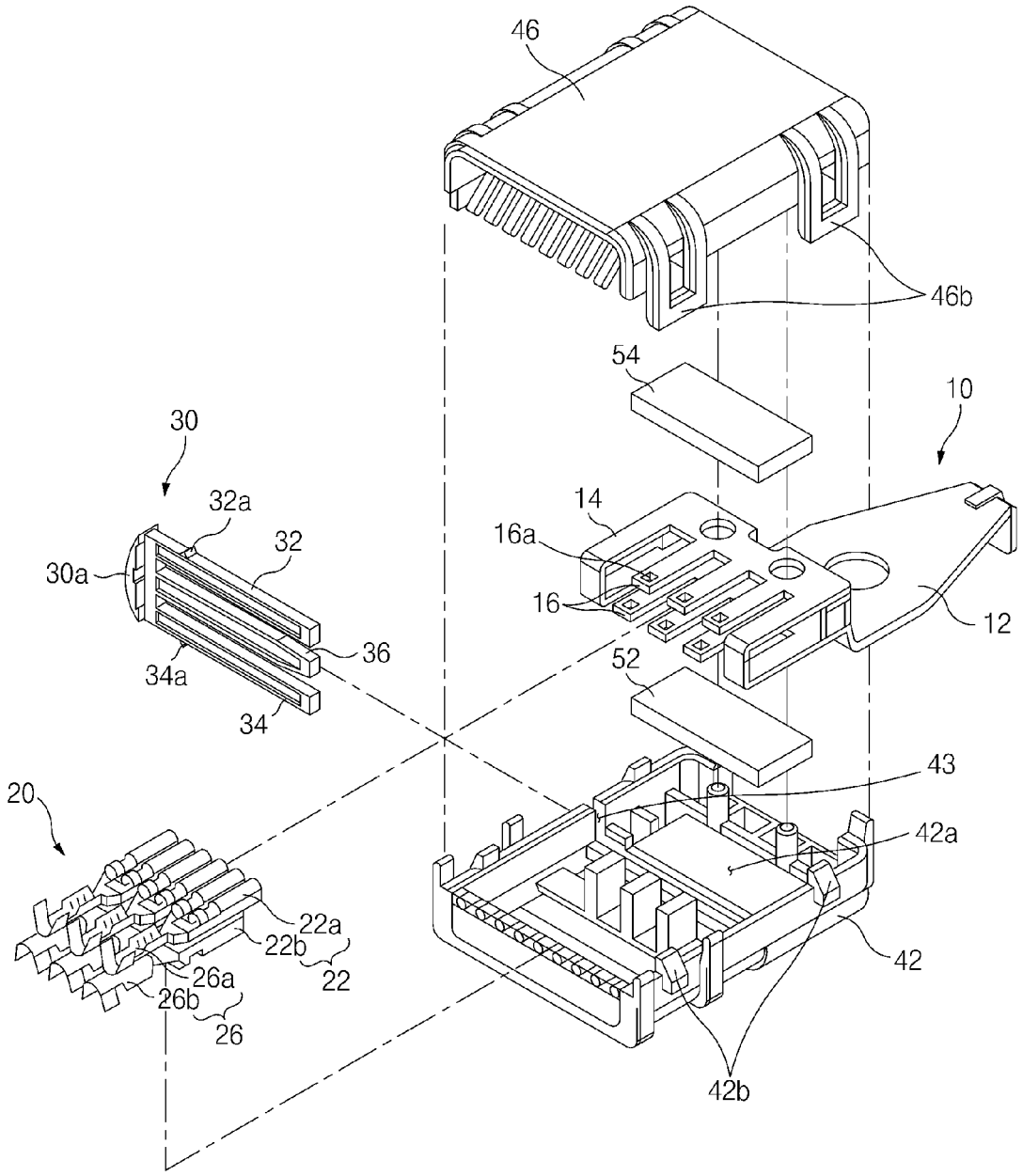
FIG. 4 is a perspective view illustrating a multi-ground connector and a side holder.
Figure 5:
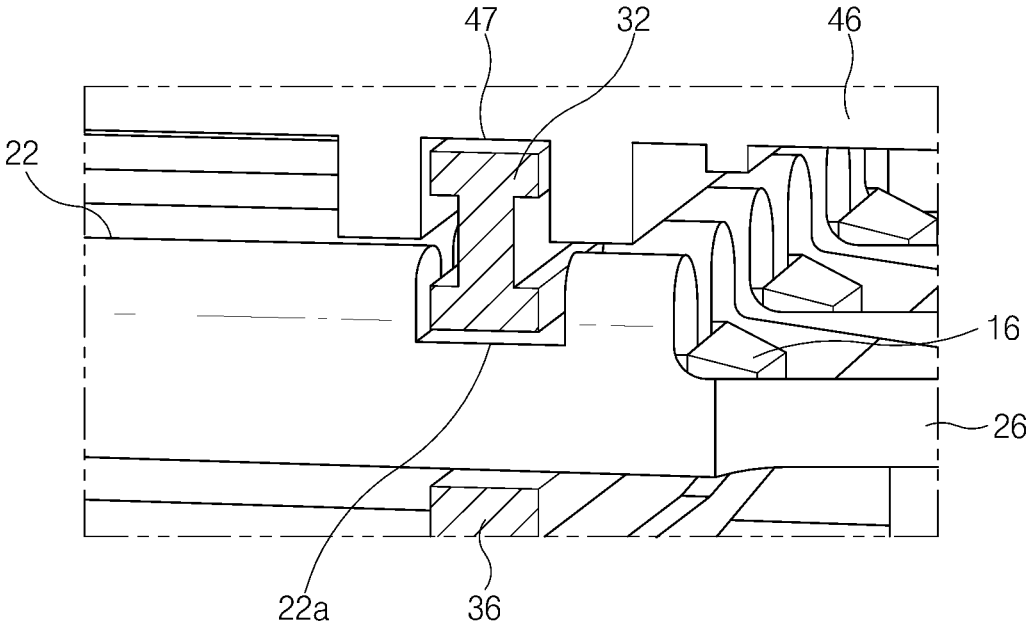
FIG. 5 is an exploded perspective view of FIG. 1.

The ground portion 12 of the ground terminal 10 may be disposed to protrude partially to the outside of the housing 20 and fixed and grounded to a vehicle. Here, the waterproof pads 52 and 54 are disposed with the pin terminals 16 mounted on the mounting recess 42*a* of the housing 40 interposed therebetween. The ground terminal 10 and the ground portion 12 are disposed between the first housing 42 and the second housing 46, and the first housing 42 and the second housing 46 are coupled by inserting the hook stoppage portions 46*b* to the hook portions 42*b*. As illustrated in FIG. 4, the side holder 30 is inserted in a direction perpendicular to the socket terminal 20 disposed in the housing 40

Referring to FIG. 6, the side holder 30 is inserted into the interior of the housing 40 along the guide recesses 43 and 47 through insertion recesses of the housing 40. Here, the first guide portion 32 of the side holder 30 is moved along the guide recess 47 of the second housing 46 and also moved along the insertion recess 22*a*' of the first socket 22*a*.

Figure 3:
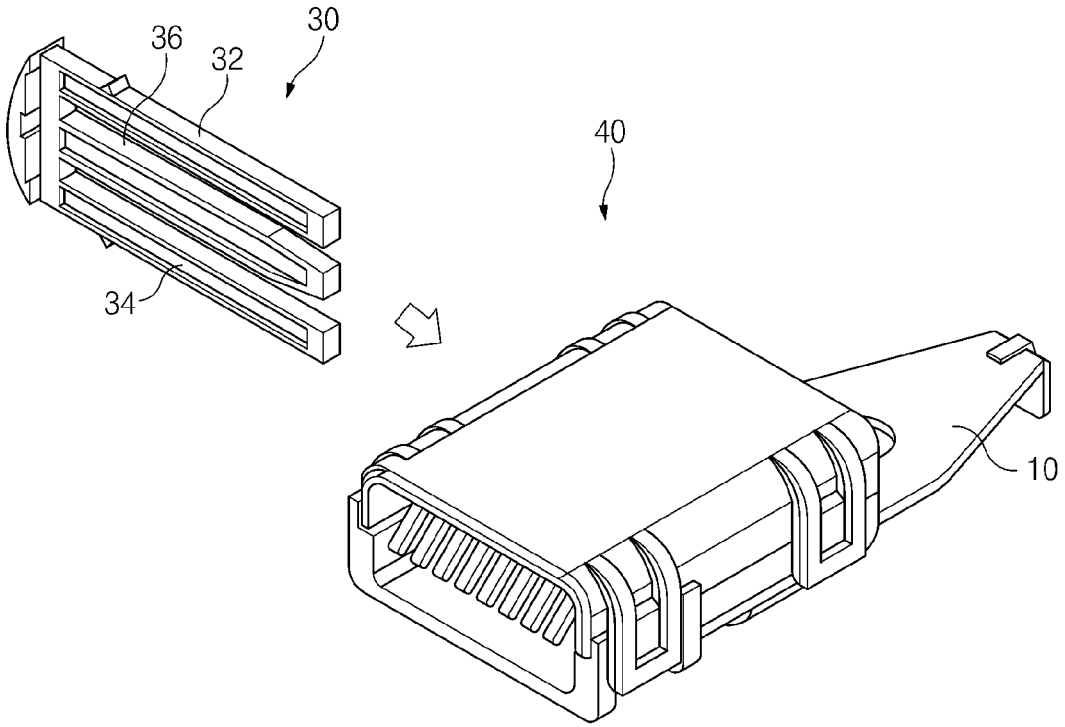
FIG. 3 is a front view of FIG. 2.

The second guide portion 34 of the side holder 30 is moved along the guide recess 43 of the first housing 42 and also moved along the insertion recess of the second socket 22*b*. Referring to FIG. 3, the third guide portion 36 penetrates through a space between the first socket 22*a* and the second socket 22*b*.

Referring back to FIGS. 4 and 5, the socket terminal 20 is fixed by the protrusion 24 of the socket 22 and the stoppage hole 16*a* of the ground terminal 10. Thereafter, the side holder 30 is inserted into the housing 40 to fix the socket terminal 20 and the ground terminal 10 and simultaneously inhibit a movement of the socket terminal 20 and the ground terminal 10 coupled in the housing 40.

Also, the coupling holes 32*a* and 34*a* of the first guide portion 32 and the second guide portion 34 of the side holder 30 are caught in the housing 40 to inhibit excessive entering and releasing of the side holder 30, thus firmly supporting the socket 20 and the ground terminal 10.

According to the multi-ground connector for a vehicle according to the present disclosure, the plurality of pin terminals may be provided and arranged in a plurality of rows, reducing a volume of the connector and increasing the number of connectable terminals. Also, since the socket terminals and the pin terminal are coupled to inhibit a movement of the socket terminal, and when the socket terminal and the pin terminals are coupled and the side holder is installed, a movement of the socket terminal is further inhibited. Also, since the side holder is inserted from outside of the housing, a coupling rate of the socket terminal and the pin terminals is enhanced, and whether the socket terminal and the pin terminals are fastened may be known through coupling of the side holder. Also, since the socket terminal and the pin terminals are provided within the housing, aesthetic appearance and stability may be enhanced.

As described above, the multi-ground connector for a vehicle according to one form of the present disclosure may have the following advantages.

First, since the plurality of pin terminals are provided and arranged in a plurality of rows, a volume of the connector may be reduced and the number of connectable terminals may be increased.

Second, since the socket terminals and the pin terminal are coupled, a movement of the socket terminal may be inhibited Third, when the socket terminal and the pin terminals are coupled and the side holder is installed, a movement of the socket terminal is further inhibited.

Fourth, since the side holder is inserted from outside of the housing, a coupling rate of the socket terminal and the pin terminals is enhanced, and whether the socket terminal and the pin terminals are fastened may be known through coupling of the side holder.

Fifth, since the socket terminal and the pin terminals are provided within the housing, aesthetic appearance and stability may be enhanced.

Sixth, manually manufactured components may be manufactured through an automation process, reducing manufacturing cost and a defect generation rate.

Technical effects of the present disclosure are not limited to the foregoing technical effects and any other technical effects not mentioned will be understood from the following descriptions and become apparent by exemplary forms of the present disclosure.

The configuration and method of the multi-ground connector for a vehicle according to the exemplary forms of the present disclosure described above are not limited in its application, but the exemplary forms may be selectively combined to be configured into various modifications.

The present disclosure may be variously modified and altered by those skilled in the art to which the present disclosure pertains without departing from the spirit and scope of the present disclosure claimed in the following claims.

What is claimed is:

1. A multi-ground connector for a vehicle, the multi-ground connector comprising:

a ground terminal including a ground portion fixed to a vehicle body and pin terminals arranged in a plurality of rows;

a socket terminal including sockets configured to receive the pin terminals and barrels to which a ground wiring is fixed; and a side holder coupled with the sockets and configured to inhibit a movement of the socket terminal, wherein the sockets are formed in a plurality of rows so as to receive the pin terminals, and the sockets comprises:

first sockets in one row; and second sockets in one row below the first sockets, the second sockets disposed between valleys of the first sockets, and wherein the side holder includes a plurality of guide portions configured to be inserted into the first sockets and the second sockets, the plurality of guide portions including:

a first guide inserted into an upper side of the first sockets;

a second guide inserted into a lower side of the second sockets; and a third guide disposed between the first guide and the second guide and configured to penetrate through a space between the first sockets and the second sockets.

2. The multi-ground connector according to claim 1, wherein the pin terminals are arranged such that first terminals thereof are inserted into the first sockets and second terminals are staggered with respect to the first terminals so that the second terminals are inserted into the second sockets.

3. The multi-ground connector according to claim 1, wherein the first sockets and the second sockets each have an insertion recess into which the side holder is inserted.

4. The multi-ground connector according to claim 3, wherein an end portion of the first sockets and second sockets forms a protrusion which protrudes toward an interior of the first and second sockets.

5. The multi-ground connector according to claim 4, wherein a stoppage hole is formed at a front end of each of the pin terminals and is coupled to the protrusion to inhibit a movement of the socket terminal.

6. The multi-ground connector according to claim 1, wherein the sockets each have a U shape surrounding the pin terminals.

7. The multi-ground connector according to claim 1, further comprising a housing in which the ground terminal and the socket terminal are disposed therein, wherein the ground terminal is disposed such that the ground portion and the ground wiring protrude outwardly from the housing.

8. The multi-ground connector according to claim 7, wherein the housing comprises a guide recess configured to allow the side holder to be inserted therein, and the side holder is inserted into the guide recess and an insertion recess.

9. The multi-ground connector according to claim 8, wherein a coupling hole to be caught by the housing is formed in each of a first guide and a second guide.

10. The multi-ground connector according to claim 7, wherein the housing includes:

a first housing configured to have an accommodation space in which the ground terminal and the sockets are disposed; and a second housing coupled to a top of the first housing, wherein a waterproof pad configured to protect the ground terminal and the sockets is disposed in the accommodation space.

11. The multi-ground connector according to claim 10, wherein a plurality of waterproof pads are provided, and the pin terminals are disposed between the plurality of waterproof pads.

12. The multi-ground connector according to claim 10, wherein a mounting recess on which the waterproof pad is disposed is formed in the accommodation space, and the pin terminals are disposed on the waterproof pad disposed on the mounting recess.

13. A multi-ground connector for a vehicle, comprising:

a ground terminal including a ground portion fixed to a vehicle body and pin terminals arranged in a plurality of rows;

a socket terminal including first sockets and second sockets that are configured to receive the pin terminals and barrels to which a ground wiring is fixed; and a side holder coupled with the sockets to traverse the sockets and the pin terminals and configured to inhibit a movement of the socket terminal, wherein the side holder includes a plurality of guide portions configured to be inserted into the first sockets and the second sockets, the plurality of guide portions including:

a first guide inserted into an upper side of the first sockets;

a second guide inserted into a lower side of the second sockets; and a third guide disposed between the first guide and the second guide and configured to penetrate through a space between the first sockets and the second sockets.

14. The multi-ground connector according to claim 13, further comprising a housing in which the ground terminal and the socket terminal are disposed therein, wherein an insertion recess configured to allow the side holder to be inserted therein is formed in each of the first sockets and the second sockets, and the housing has a guide recess configured to allow the side holder to be inserted therein, and the side holder is inserted into the insertion recess and the guide recess.

* * * * *